US012281837B2

(12) United States Patent
Li et al.

(10) Patent No.: US 12,281,837 B2
(45) Date of Patent: Apr. 22, 2025

(54) REFRIGERATOR DOOR WITH REPLACEABLE DOOR SURFACE

(71) Applicants: QINGDAO HAIER SPECIAL REFRIGERATOR CO., LTD., Qingdao (CN); QINGDAO HAIER REFRIGERATOR CO., LTD., Qingdao (CN); HAIER SMART HOME CO., LTD., Qingdao (CN)

(72) Inventors: Jiaming Li, Qingdao (CN); Hao Zhang, Qingdao (CN); Zhiwei Ren, Qingdao (CN); Peng Lv, Qingdao (CN)

(73) Assignees: QINGDAO HAIER SPECIAL REFRIGERATOR CO., LTD., Qingdao (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 77 days.

(21) Appl. No.: 18/020,622

(22) PCT Filed: Sep. 9, 2021

(86) PCT No.: PCT/CN2021/117338
§ 371 (c)(1),
(2) Date: Feb. 9, 2023

(87) PCT Pub. No.: WO2022/033602
PCT Pub. Date: Feb. 17, 2022

(65) Prior Publication Data

US 2023/0324104 A1 Oct. 12, 2023

(30) Foreign Application Priority Data

Aug. 10, 2020 (CN) ..... 202010795016.1

(51) Int. Cl.
*F25D 23/02* (2006.01)

(52) U.S. Cl.
CPC ..... *F25D 23/028* (2013.01); *F25D 2400/18* (2013.01)

(58) Field of Classification Search
CPC ..... E05B 2015/0455; E05B 65/0042; F25D 2400/18; F25D 23/028
See application file for complete search history.

(56) References Cited

U.S. PATENT DOCUMENTS 1,810,531 A * 6/1931 Rubin ..... E05B 65/0042 292/332
2010/0295425 A1 11/2010 Kim
(Continued)

FOREIGN PATENT DOCUMENTS

CN 1641171 A 7/2005
CN 201363000 Y 12/2009
(Continued)

*Primary Examiner* — Matthew W Ing
(74) *Attorney, Agent, or Firm* — Cheng-Ju Chiang

(57) ABSTRACT

The present invention discloses a refrigerator door with a replaceable door surface, including: a foamed door body and a door shell plate; wherein a rear side of the door shell plate is provided with a hook; a front side of the foamed door body is provided with a press lock catch, which comprises a snap tab; and when the door shell plate is assembled on the front side of the foamed door body, the hook is snapped into the snap tab to limit the displacement of the door shell plate in a front-rear direction. In the present invention, the locking or unlocking between the hook and the snap tab is achieved by rotating the snap tab, which is rotatable in the press lock catch, between the first position and the second position, such that the door shell plate and the foamed door body are more convenient to assemble and disassemble.

17 Claims, 6 Drawing Sheets

(56) References Cited

U.S. PATENT DOCUMENTS

| | | | | |
|---|---|---|---|---|
| 2013/0026900 | A1* | 1/2013 | Oh | F25D 23/028 312/401 |
| 2013/0169139 | A1 | 7/2013 | Jung et al. | |
| 2018/0092457 | A1* | 4/2018 | Lai | A47B 9/20 |
| 2018/0274852 | A1 | 9/2018 | Kang et al. | |
| 2020/0386010 | A1* | 12/2020 | Lv | E05B 15/0093 |

FOREIGN PATENT DOCUMENTS

| | | | |
|---|---|---|---|
| CN | 202266109 | U | 6/2012 |
| CN | 102691983 | A | 9/2012 |
| CN | 102997573 | A | 3/2013 |
| CN | 104329882 | A | 2/2015 |
| CN | 205860639 | U | 1/2017 |
| CN | 107677035 | A | 2/2018 |
| CN | 207299701 | U | 5/2018 |
| CN | 207405601 | U | 5/2018 |
| CN | 109267855 | A | 1/2019 |
| CN | 110159112 | A | 8/2019 |
| CN | 210220367 | U | 3/2020 |
| CN | 210625093 | U | 5/2020 |
| DE | 202006013097 | U1 | 1/2007 |
| KR | 1999-0069233 | A | 9/1999 |
| NL | 1009121 | C2 | 11/1999 |

* cited by examiner

REFRIGERATOR DOOR WITH REPLACEABLE DOOR SURFACE

CROSS REFERENCE TO RELATED APPLICATIONS

The present invention is a 35 U.S.C. § 371 National Phase conversion of International (PCT) Patent Application No. PCT/CN2021/117338, filed on Sep. 9, 2021, which claims benefit of Chinese Application No. 202010795016.1, filed on Aug. 10, 2020, the disclosure of which is incorporated by reference herein. The PCT International Patent Application was filed and published in Chinese.

TECHNICAL FIELD

The present invention relates to the technical field of household appliances, and in particular to a refrigerator door with a replaceable door surface.

BACKGROUND

With the continuous development of science and technology, refrigerators have become one of indispensable household appliances. In existing applications, with the increasingly higher requirements of user needs, refrigerators are not only used as household appliances, but also as decorations in the family environment. Before buying a refrigerator, a user usually has many requirements for the color and pattern of the appearance of the refrigerator, but the monotonous appearance of the refrigerator affects the purchasing needs of the user. In addition, because the service life of the refrigerator can usually reach 8 to 10 years, the appearance of the refrigerator cannot meet the long-term adjustment need of the user during his/her use with the change of environment and scene after the single-time purchase of the refrigerator. In another case, there is also a risk of door surface breakage during the use and transportation of the refrigerator. In the several cases above, if the entire door body of the refrigerator is replaced, the replacement cost is high, and the use of the refrigerator is affected, which is not conducive to meeting the needs of consumers.

SUMMARY

An object of the present invention is to provide a refrigerator door with a replaceable door surface, in order to solve the problem that a veneer on a refrigerator door in the prior art is difficult to replace or has high replacement cost.

In order to achieve one of the above object, an embodiment of the present invention provides a refrigerator door with a replaceable door surface, comprising:

- a foamed door body and a door shell plate detachably connected to the foamed door body;
- wherein a rear side of the door shell plate is provided with a hook; a front side of the foamed door body is provided with a press lock catch, which comprises a snap tab; and
- when the door shell plate is assembled on the front side of the foamed door body, the hook is snapped into the snap tab to limit the displacement of the door shell plate in a front-rear direction.

As an optional embodiment, wherein the press lock catch comprises a lock case, which comprises an assembly cavity in which the snap tab is rotatably assembled, wherein when the snap tab is rotated in the assembly cavity to a first position in a first direction, the hook is snapped into the snap tab; when the snap tab is rotated in the assembly cavity to a second position in a second direction, the hook is disengaged from the snap tab; and the first direction and the second direction are opposite.

As an optional embodiment, wherein the press lock catch further comprises a fixed seat, a compression torsional spring, and a lock knob, both ends of the compression torsional spring are respectively fixed to the fixed seat and the lock knob, and the fixed seat, the compression torsional spring, and the lock knob are respectively accommodated in an accommodation cavity of the snap tab; and wherein the compression torsional spring is capable of driving the fixed seat, the lock knob, and the snap tab to rotate together between the first position and the second position.

As an optional embodiment, wherein a first positioning portion is disposed on an inner wall of the accommodation cavity of the snap tab, a second positioning portion is disposed on an outer wall of the lock knob, and the first positioning portion and the second positioning portion are in snap fit with each other to limit the axial rotation of the lock knob in the accommodation cavity.

As an optional embodiment, wherein the lock knob comprises an outer end portion, and an annular surface of the outer end portion comprises a plurality of first locking members; an outer side wall of the lock case comprises a hole portion, and a hole wall of the hole portion comprises a plurality of second locking members; wherein the outer end portion matches with the hole portion, and when the snap tab is rotated to the first position, each first locking member and each second locking member are locked with each other.

As an optional embodiment, wherein the press lock catch further comprises a button, and an outer side of the outer side wall is provided with an insertion hole, into which the button is inserted; wherein the insertion hole and the hole portion are communicated with each other, and the button is pressed to pass through the insertion hole and push the outer end portion in the hole portion, such that the lock knob axially moves in the accommodation cavity, and the first locking members and the second locking members are unlocked.

As an optional embodiment, wherein the button comprises a push rod therein; and the push rod enters the hole portion and pushes the outer end portion, a first positioning portion slides along a second positioning portion, and the compression torsional spring is compressed, such that the first locking members and the second locking members are unlocked.

As an optional embodiment, wherein the first locking members are recesses formed in the outer end portion; the second locking members are bulges formed on the hole wall; and wherein the bulges are snapped into the recesses, such that the lock knob and the lock case are locked.

As an optional embodiment, wherein the plurality of first locking members is evenly distributed on the annular surface in a circumferential direction in accordance with a first angle; an angle at which the snap tab rotates between the first position and the second position is defined as a second angle; and wherein the first angle is greater than the second angle.

As an optional embodiment, wherein the fixed seat, the compression torsional spring, and the lock knob are accommodated in the accommodation cavity, and when the snap tab is at the second position, the compression torsional spring is in a torsion state.

As an optional embodiment, wherein the first positioning portion is a strip-like groove, and the second positioning portion is a strip-shaped bump.

As an optional embodiment, wherein the snap tab comprises a snap slot, which protrudes from a cylindrical body of the snap tab; the hook is a U-shaped frame, and an opening of the U-shaped frame is connected to the rear side of the door shell plate; and wherein a cross bar of the U-shaped frame is snapped into the snap tab.

Compared with the prior art, the present invention provides the refrigerator door with the replaceable door surface, in which a press lock catch is installed in a foamed door body, a hook is installed on a rear side of a door shell plate, and the locking or unlocking between the hook and a snap tab is achieved by rotating the snap tab, which is rotatable in the press lock catch, between a first position and a second position, such that the door shell plate and the foamed door body are more convenient to assemble and disassemble.

DETAILED DESCRIPTION

Figure 1:
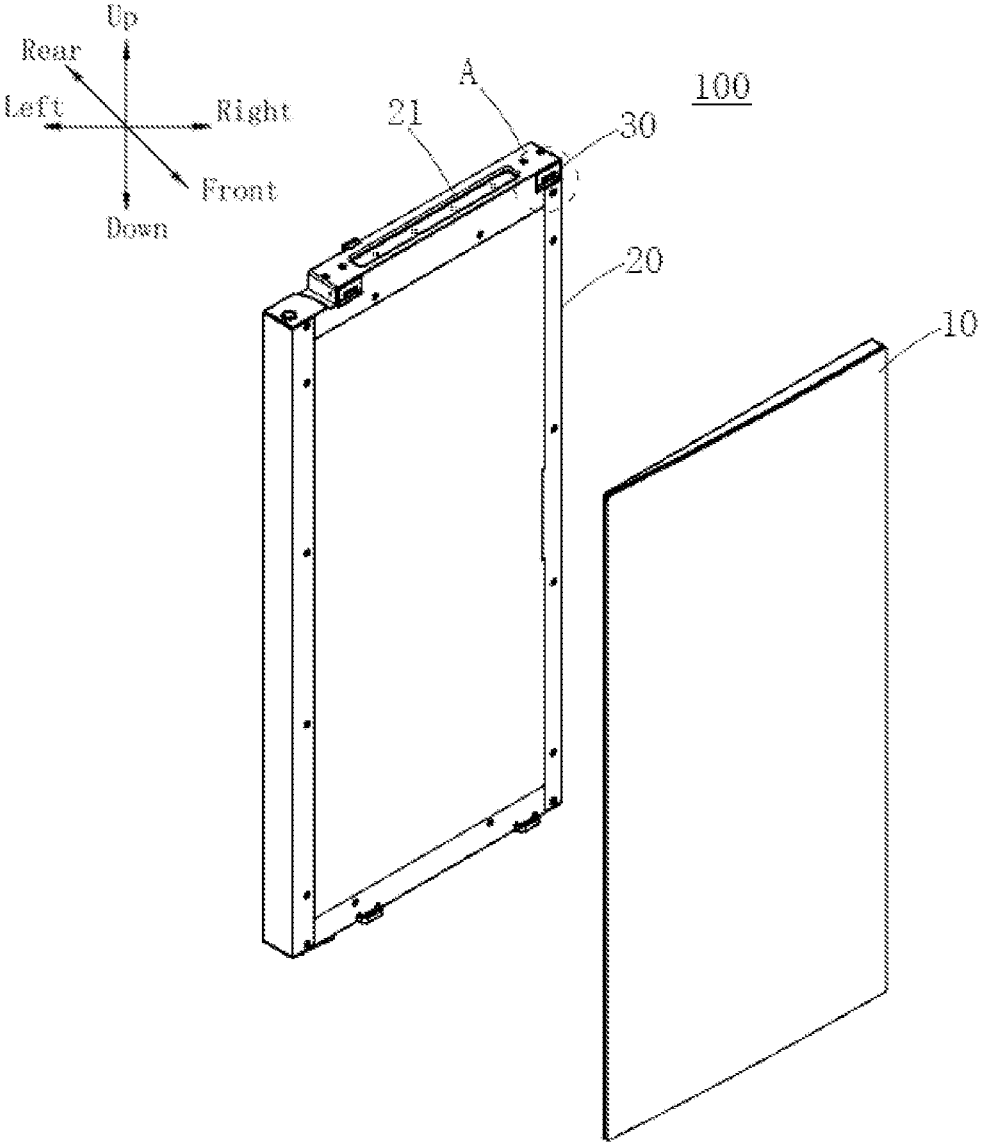
FIG. 1 is a schematic exploded view of a refrigerator door with a replaceable door surface according to an embodiment of the present invention.
Figure 2:
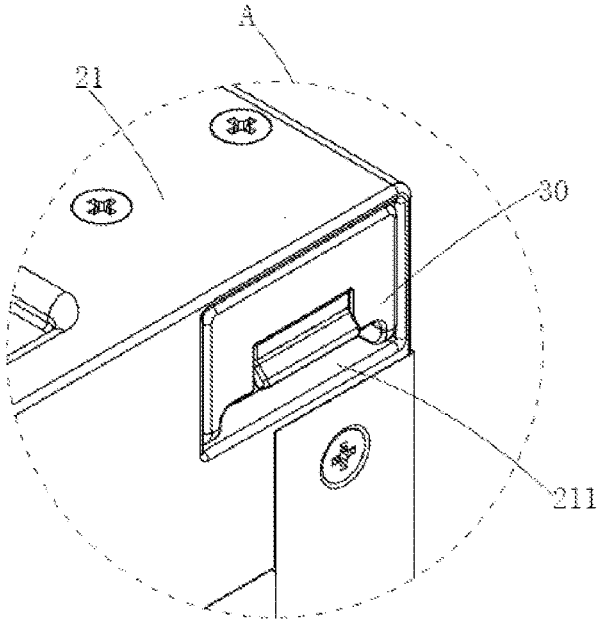
FIG. 2 is a schematic enlarged view at a dashed line A in FIG. 1.
Figure 3:
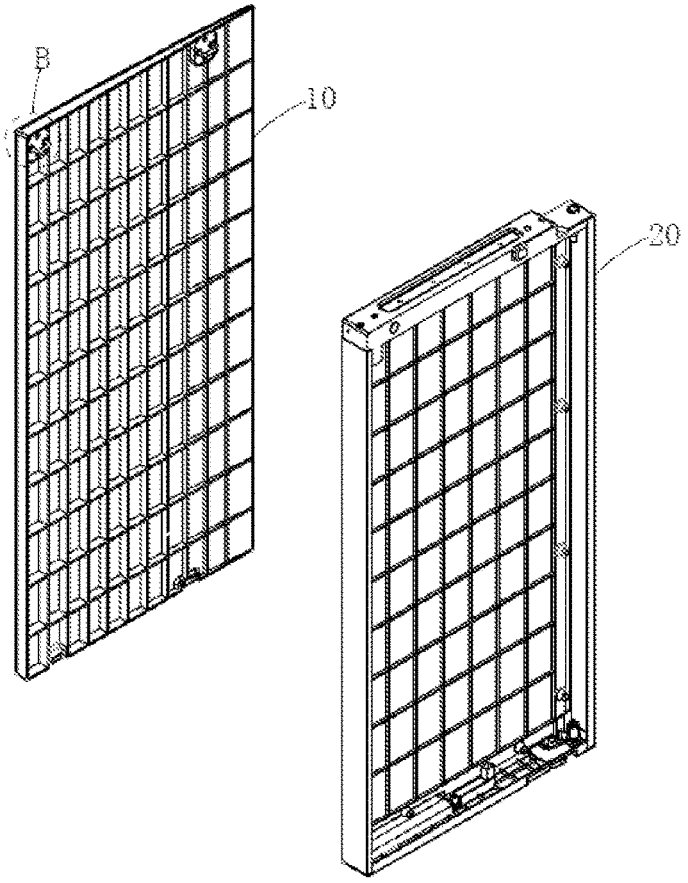
FIG. 3 is a schematic exploded view of the refrigerator door with the replaceable door surface in FIG. 1 from another view of angle.

The present invention will be described in detail below in conjunction with the specific embodiments shown in the accompanying drawings. However, these embodiments are not intended to limit the present invention, and any changes made by those of ordinary skills in the art to the structures, methods or functions according to these embodiments shall fall within the protection scope of the present invention.

As shown in FIGS. 1 to 6, a refrigerator door 100 with a replaceable door surface includes a foamed door body 20 and a door shell plate 10 detachably connected to the foamed door body 20. The rear side of the door shell plate 10 is provided with a hook 40; and the front side of the foam door body 20 is provided with a press lock catch 30, which includes a snap tab 32. When the door shell plate 10 is assembled on the front side of the foamed door body 20, the hook 40 is snapped into the snap tab 32 to limit the displacement of the door shell plate 10 in a front-rear direction.

In this embodiment, the foamed door body 20 includes a door body and a peripheral trim strip, and the press lock catch 30 is disposed in the peripheral trim strip. For example, the press lock catch 30 is fixed in a fixing hole 211 on the front side of an upper trim strip 21 of the peripheral trim strip. The hook 40 extends from the front side of the fixing hole 211, pressing against the snap tab 32 of the press lock catch 30 to rotate the snap tab 32 to a first position, such that the hook 40 and the snap tab 32 are in snap fit with each other to limit the displacement of the door shell plate 10 in the front-rear direction. When the snap tab 32 is rotated to a second position, the hook 40 is disengaged from the snap tab 32 to release the snap-fit relationship between the hook 40 and the snap tab 32, such that the displacement of the door shell plate 10 in the front-rear direction is removed.

It should be noted that the displacements of the door shell plate 10 and the foamed door body 20 in vertical and horizontal directions can be limited by the existing snap-fit structure and/or magnet adsorption or other detachable methods, which will not be repeated herein. When all the structures for limiting the displacements of the door shell plate 10 in the vertical, horizontal and front-rear directions are removed, the door shell plate 10 may be disassembled from the front side of the foamed door body 20.

Figure 4:
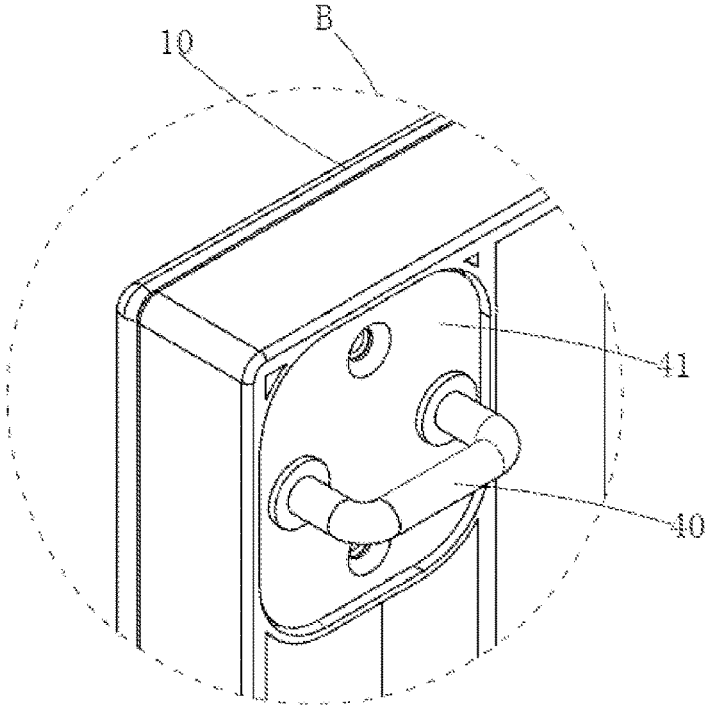
FIG. 4 is a schematic enlarged view at a dashed line B in FIG. 3.
Figure 10:
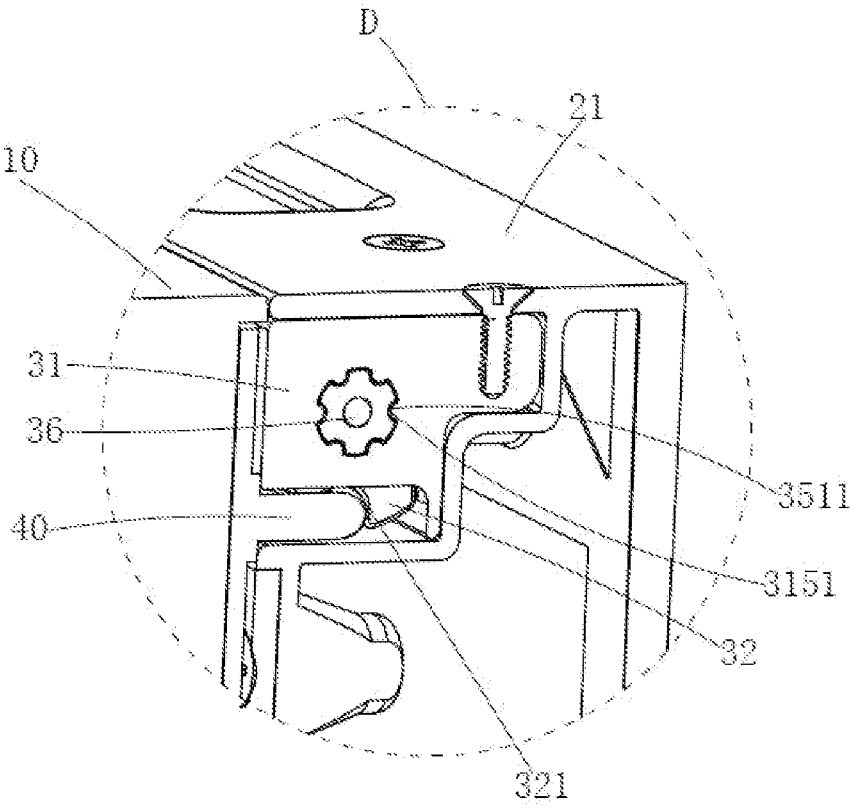
FIG. 10 is schematic enlarged view at a dashed line D in FIG. 9.

As shown in FIG. 4, the hook 40 is, for example, a U-shaped frame, and an opening of the U-shaped frame is connected to the rear side of the door shell plate 10. Here, a cross bar at the bottom of the U-shaped frame is parallel to the door shell plate 10, and may be snapped into a snap slot 321 in the snap tab 32 (as shown in FIG. 10).

The hook 40 is fixed to the rear side of the door shell plate 10 by a connecting plate 41 and screws.

Figure 5:
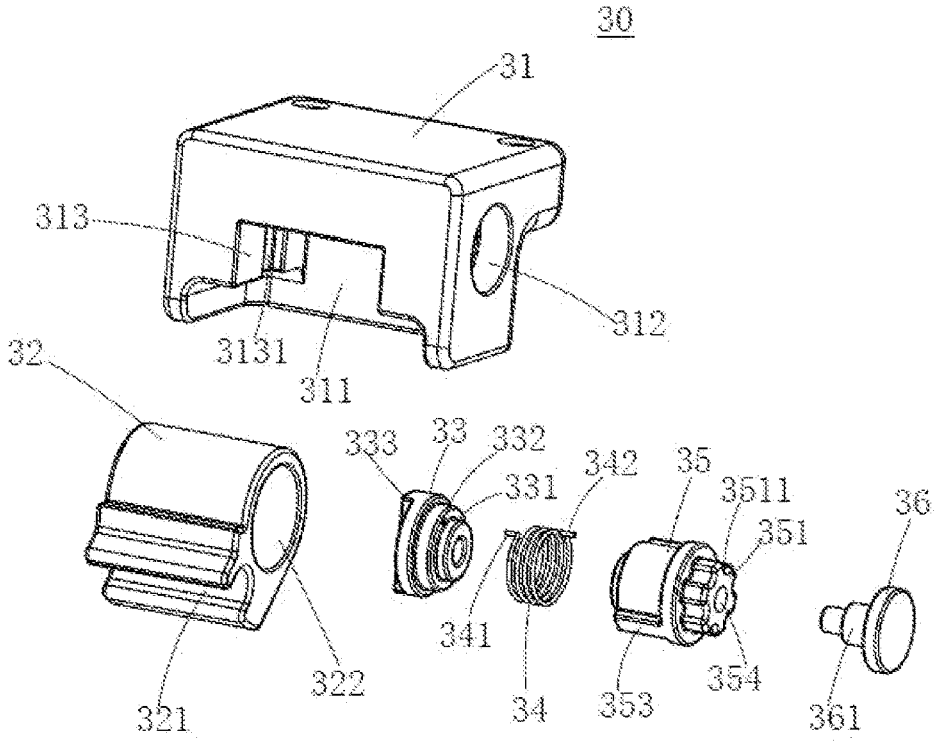
FIG. 5 and FIG. 6 are schematic exploded views of a press lock catch from different angles of view.
Figure 6:
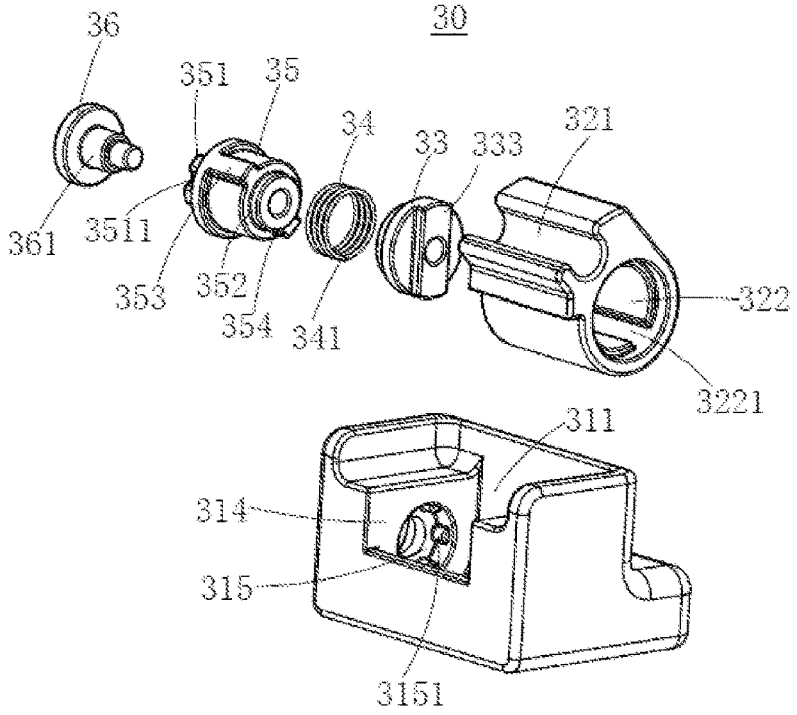

As shown in FIGS. 5 and 6, the press lock catch 30 includes a lock case 31, and the snap tab 32 is rotatably assembled in an assembly cavity 311 of the lock case 31. When the snap tab 32 is rotated in the assembly cavity 311 to the first position in a first direction, the hook 40 is snapped into the snap slot 321 of the snap tab 32; and when the snap tab 32 is rotated in the assembly cavity 311 to the second position in a second direction, the hook 40 may be disengaged from the snap slot 321 of the snap tab 32. Here, the first direction and the second direction are opposite.

In this embodiment, the snap tab 32 rotates in a counterclockwise direction and moves towards the rear side of the assembly cavity 311, such that the snap tab 32 is locked in the assembly cavity 311 of the lock case 31, and the hook 40 is snapped into the snap slot 321 of the snap tab 32; and the snap tab 32 rotates in a clockwise direction and moves towards the front side of the assembly cavity 311, such that the snap tab 32 and the assembly cavity 311 are unlocked, and the hook 40 may be disengaged from the snap slot 321 of the snap tab 32.

The snap tab 32 includes a columnar body having a hollow structure, in which an accommodation cavity 322 is defined, and the exterior of the columnar body protrudes from the snap slot 321.

Specifically, the press lock catch 30 further includes a fixed seat 33, a compression torsional spring 34, and a lock knob 35, which are connected in sequence. The compression torsional spring 34 includes opposing fixed end 341 and free end 342; the fixed end 341 is fixed in a first connecting hole 332 of the fixed seat 33; and the free end 342 is fixed in a second connecting hole 354 of the lock knob 35.

Further, the fixed seat 33 is provided with a first connecting portion 331 on a side facing the compression torsional spring 34; the lock knob 35 is provided with a second connecting portion 352 on a side facing the compression torsional spring 34; the first connecting portion 331 and the second connecting portion 352 face each other; and a coil portion in the middle of the compression torsional spring 34 is sleeved on the first connecting portion 331 and the second connecting portion 352.

In this embodiment, the fixed seat 33, the compression torsional spring 34 and the lock knob 35 are preassembled, with the compression torsional spring 34 in a torsion state.

The assembled fixed seat 33, compression torsional spring 34 and lock knob 35 are accommodated together in the accommodation cavity 322 of the snap tab 32. An inner wall of the accommodation cavity 322 is provided with a first positioning portion 3221; an outer wall of the lock knob 35 is provided with a second positioning portion 353; and the first positioning portion 3221 and the second positioning portion 353 cooperate with each other to limit the axial rotation of the lock knob 35 in the accommodation cavity 322. In other words, the relative positions of the lock knob 35 and the snap tab 32 are fixed, and when the lock knob 35 rotates axially under the action of the compression torsional spring 34, the lock knob 35 drives the snap tab 32 to rotate axially together.

In addition, the fixed seat 33 matches with one end of the accommodation cavity 322; the fixed seat 33 is provided with a fixed portion 333 at a side away from the compression torsional spring 34; the fixed portion 333 protrudes from one end of the accommodation cavity 322; and the fixed portion 333 matches with a groove 3131 of an inner side wall 313 of the lock case 31. When the compression torsional spring 34 drives the lock knob 35 to drive the snap tab 32 to rotate axially, the fixed seat 33 is restricted by the groove 3131 from rotating, such that the compression torsional spring 34 is capable of twisting and restoring.

As shown in FIGS. 5 and 6, the lock knob 35 is provided with a plurality of first locking members 3511 on an annular surface of an outer end portion 351 away from the compression torsional spring 34; the outer side wall 314 of the lock case 31 includes a hole portion 315, and a hole wall of the hole portion 315 is provided with a plurality of second locking members 3151; and the outer end portion 351 matches with the hole portion 315. When the snap tab 32 is rotated to the first position, each first locking member 3511 and each second locking member 3151 are locked with each other.

The first locking members 3511 are recesses formed in the outer end portion 351; the second locking members 3151 are bulges formed on the hole wall of the hole portion 315. When the bulges are snapped into the recesses, the lock knob 35 and the lock case 31 are locked with each other, that is, the snap tab 32 is locked in the assembly cavity 311 of the lock case 31.

In a preferred embodiment, the plurality of recesses is evenly distributed in a circumferential direction along the annular surface of the outer end portion 351 in accordance with a first angle; and the plurality of bulges is evenly distributed in a circumferential direction along the hole wall of the hole portion 315 in accordance with the same first angle. Under the drive of the compression torsional spring 34, the lock knob 35 drives the snap tab 32 to rotate axially together in the assembly cavity 311 of the lock case 31. An axial rotation angle of the snap tab 32 between the first position and the second position is defined as a second angle, with the first angle greater than the second angle.

Since the first angle is greater than the second angle, when the snap tab 32 is rotated to the second position, the plurality of recesses 3511 on the outer end portion 351 of the lock knob 35 are not in snap fit with the plurality of bulges 3151 on the hole portion 315 of the outer side wall 314 of the lock case 31, such that the lock knob 35 and the lock case 31 are not locked with each other. That is, the snap tab 32 and the assembly cavity 311 of the lock case 31 are not locked with each other. Therefore, during the next assembly, the snap tab 32 can be pushed against by the hook 40 again to rotate towards the first position, and then relocked in the assembly cavity 311 of the lock case 31.

In this embodiment, the number of the plurality of recesses 3511 is, for example, 6; the 6 recesses 3511 are evenly distributed along the circumference; therefore; the first angle is 60°. In addition, the second angle at which the snap tab 32 can rotate in the assembly cavity 311 is 45°, but the second angle is not limited thereto.

In other embodiments of the present invention, the number of the recesses in the outer end portion of the lock knob may also be 4, 9, etc.; with any adjacent recesses spaced by the first angle, and the first angle is greater than the second angle at which the snap tab is rotated axially between the first position and the second position.

As shown in FIGS. 5 and 6, the press lock catch 30 further comprises a button 36, which is penetratively disposed in an insertion hole 312, at the outer side of the outer side wall 314 of the lock case 31. The button 36 is inserted in the insertion hole 312. Here, the insertion hole 312 and the hole portion 315 are communicated with each other. By pressing the button 36, the button 36 passes through the insertion hole 312 to push the outer end portion 351 of the lock knob 35 in the hole portion 315, such that the lock knob 35 moves axially in the accommodation cavity 322 of the snap tab 32, and the plurality of recesses 3511 and the plurality of bulges 3151 are unlocked. At this time, the coil portion of the compression torsional spring 34 is compressed.

Preferably, the button 36 is provided with a push rod 361 therein. The push rod 361 includes two cylinders with different diameters. The diameters of the cylinders decrease from the outer side to the inner side. Here, the small-diameter cylinder at the inner side of the push rod 361 passes through the insertion hole 312 and the hole portion 315 in sequence, and then enters the positioning hole 354 in the outer end portion 351 of the lock knob 35, thereby increasing the assembly stability between the button 36 and the lock knob 35.

In this embodiment, by pressing the button 36, the large-diameter cylinder of the push rod 361 passes through the insertion hole 312 to enter the hole portion 315 and push the outer end surface of the outer end portion 351, such that the lock knob 35 presses the coil portion of the compression torsional spring 34, and the lock knob 35 slides inwards axially in the accommodation cavity 322 of the snap tab 32. When the lock knob 35 slides in the accommodation cavity 322, the second positioning portion 353 slides along the first positioning portion 3221. Here, the first positioning portion 3221 is, for example, a strip-like groove formed in the inner wall of the accommodation cavity 322 and extending axially; the second positioning portion 353 is, for example, a strip-like bump formed in the annular outer wall of the lock knob 35 and extending axially; and the strip-like bump slides in the strip-like groove.

In other embodiments of the present invention, the first positioning portion is, for example, a strip-like groove formed in the inner wall of the accommodation cavity and extending axially; and the second positioning portion is, for example, a strip-like bump formed in the annular outer wall and extending axially. Without doubt, the first positioning portion and the second positioning portion may also have other shapes.

In addition, the upper trim strip 21 of the foamed door body 20 is further provided with an accommodation hole (not shown), and an outer end of the button 36 is embedded in the accommodation hole, and preferably, extends from the accommodation hole or is flush with the outer side of the accommodation hole, thereby facilitating a user to press the button 36.

The assembly process of the above door shell plate 10 and foamed door body 20 of the present invention will be illustrated in detail below with reference to FIGS. 7 to 10.

Figure 7:
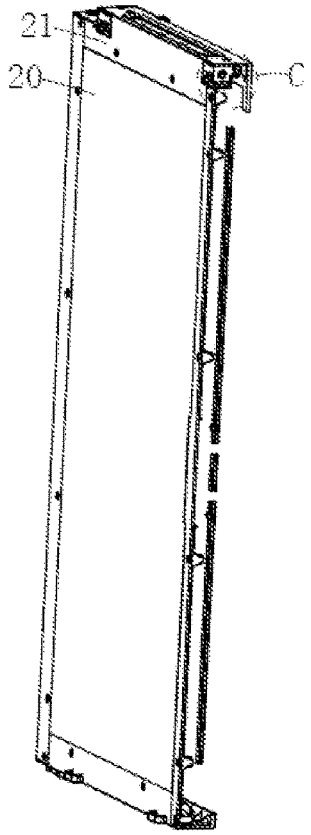
FIG. 7 is a schematic sectional view of a foamed door body in FIG. 1.
Figure 8:
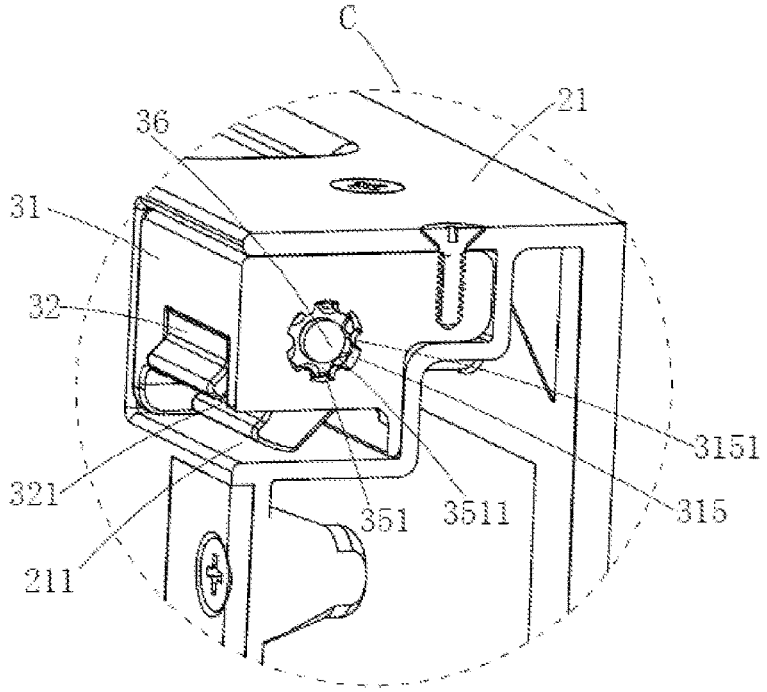
FIG. 8 is a schematic enlarged view at a dashed line C in FIG. 7.

As shown in FIGS. 7 and 8, the press lock catch 30 is assembled in the fixing hole 211 on the front side of the upper trim strip 21 of the foamed door body 20, and the lock case 31 and the upper trim strip 21 are locked with each other by screws.

The compression torsional spring 34 is twisted to an angle, such that the compression torsional spring is installed into the accommodation cavity 322 of the snap tab 32 after its assembly with the fixed seat 33 and the lock knob 35, the fixed portion 333 of the fixed seat 33 is combined with the groove 3131 in the inner side wall 313 of the lock case 31 to maintain the torsion state of the compression torsional spring 34. At this time, the plurality of recesses 3511 in the outer end portion 351 of the lock knob 35 and the plurality of bulges 3151 on the hole wall of the hole portion 315 in the outer side wall 314 of the lock case 31 are staggered with each other.

Figure 9:
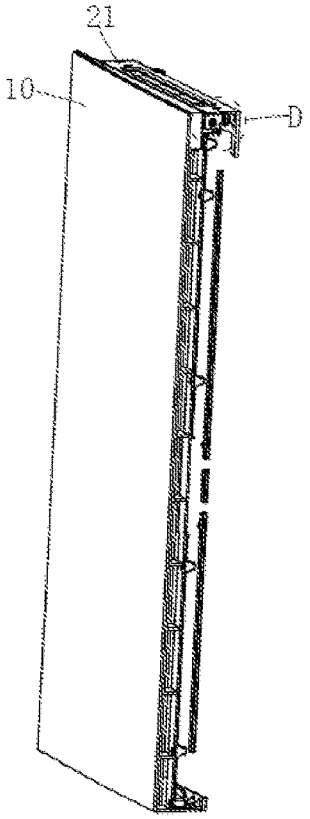
FIG. 9 is a schematic sectional view of a refrigerator door with a replaceable door surface according to the present invention.

As shown in FIGS. 9 and 10, the hook 40 on the rear side of the door shell plate 10 moves towards the fixing hole 211 on the front side of the foamed door body 20, and is inserted into the front side of the fixing hole 211; and the cross bar of the hook 40 pushes the rear side of the snap slot 321 of the snap tab 32, such that the snap tab 32 rotates counterclockwise to drive the lock knob 35 inside the snap tab 32 to rotate counterclockwise.

When the snap tab 32 is pushed to rotate counterclockwise to the first position, the plurality of recesses 3511 in the outer end portion 351 of the lock knob 35 and the plurality of bulges 3151 on the hole wall of the hole portion 315 in the outer side wall 314 of the lock case 31 are in snap fit with each other, and the lock knob 35 and the lock case 31 are locked with each other, such that the snap tab 32 is positioned at the first position and cannot rotate. At this time, the cross bar of the hook 40 is in snap fit in the snap slot 321 of the snap tab 32, the door shell plate 10 is assembled on the front side of the foamed door body 20, and the displacement of the door shell plate 10 in the front-rear direction is limited.

When the door shell plate 10 and the foamed door body 20 need to be disassembled, the button 36 on the outer side of the upper trim strip 21 is pressed to move towards the interior of the upper trim strip 21. The push rod 361 of the button 36 passes through the insertion hole 312 and hole portion 315 in the outer side wall 314 of the lock case 31, and pushes the outer end portion 351 of the lock knob 35. The second connecting portion 352 of the lock knob 35 presses the compression torsional spring 34, and then slides inwards axially in the accommodation cavity 322 in the snap tab 32. The snap-fit between the plurality of recesses 3511 in the outer end portion 351 and the plurality of bulges 3151 on the hole wall of the hole portion 315 in the outer side wall 314 is released. At this time, the compression torsional spring 34 in the torsion state provides a torsional force to drive the lock knob 35 to rotate clockwise, and the lock knob 35 drives the snap tab 32 to rotate clockwise together to the second position, such that the cross bar of the hook 40 is disengaged from the snap slot 321 of the snap tab 32, and the limit to the displacement of the door shell plate 10 in the front-rear direction is released.

In addition, after the structures for limiting the displacements of the door shell plate 10 in the vertical and horizontal directions are removed, the door shell plate 10 may be disassembled from the front side of the foamed door body 20.

It should be noted that the torsional force provided by the compression torsional spring 34 allows the second angle, at which the lock knob 35 drives the snap tab 32 to rotate axially, to be smaller than the first angle between any two adjacent recesses 3511 in the outer end portion 351 of the lock knob 35, thereby avoiding failure of the press lock catch 30 caused by the fact that, after the snap-fit between the hook 40 and the snap slot 321 is released, the button 36 is released, an axial rebound force provided by the coil portion of the compression torsional spring 34 allows the lock knob 35 to move outwards axially and to be relocked with the lock case 31, and then, the snap tab 32 cannot rotate during the next assembly of the hook 40; or avoiding the problem of complex operation caused by the fact that, during the next assembly of the hook 40, other assembly processes can be completed subsequently only after the lock knob 35 and the lock case 34 are unlocked by pressing the button 36.

In summary, the present invention provides the refrigerator door with the replaceable door surface, in which the press lock catch is installed in the foamed door body, the hook is installed on the rear side of the door shell plate, and the locking or unlocking between the hook and the snap tab is achieved by rotating the snap tab, which is rotatable in the press lock catch, between the first position and the second position, such that the door shell plate and the foamed door body are more convenient to assemble and disassemble.

It should be understood that although the present invention is described by means of embodiments in this description, each embodiment does not necessarily include only one independent technical solution. The statement mode of the description is merely for clarity, and those skilled in the art should regard the description as a whole. The technical solutions in respective embodiments may also be combined properly to create other embodiments understandable by those skilled in the art.

The series of detailed illustrations listed above are merely for specifically illustrating the feasible embodiments of the present invention, but are not intended to limit the protection scope of the present invention. Any equivalent embodiments or alternations made without departing from the technical spirit of the present invention shall fall within the protection scope of the present invention.

What is claimed is:

1. A refrigerator door with a replaceable door surface, comprising:

a foamed door body and a door shell plate detachably connected to the foamed door body;

wherein a rear side of the door shell plate is provided with a hook; a front side of the foamed door body is provided with a press lock catch, which comprises a snap tab; and when the door shell plate is assembled on the front side of the foamed door body, the hook is snapped into the snap tab to limit the displacement of the door shell plate in a front-rear direction;

wherein the press lock catch comprises a lock case, which comprises an assembly cavity in which the snap tab is rotatably assembled, wherein when the snap tab is rotated in the assembly cavity to a first position in a first direction, the hook is snapped into the snap tab; when the snap tab is rotated in the assembly cavity to a second position in a second direction, the hook is disengaged from the snap tab; and the first direction and the second direction are opposite;

wherein the press lock catch further comprises a fixed seat, a compression torsional spring, and a lock knob, both ends of the compression torsional spring are respectively fixed to the fixed seat and the lock knob, and the fixed seat, the compression torsional spring, and the lock knob are respectively accommodated in an accommodation cavity of the snap tab; and wherein the compression torsional spring is capable of driving the lock knob and the snap tab to rotate together relative to the fixed seat between the first position and the second position;

wherein at the first position, the lock knob and the lock case are locked with each other, the snap tab cannot rotate; and wherein the lock knob is configured to be released from interlocking thereof with the lock case by an axial inward sliding of the lock knob so that the released lock knob further rotates the snap tab to the second position.

2. The refrigerator door with the replaceable door surface according to claim 1, wherein a first positioning portion is disposed on an inner wall of the accommodation cavity of the snap tab, a second positioning portion is disposed on an outer wall of the lock knob, and the first positioning portion and the second positioning portion are in snap fit with each other to limit the axial rotation of the lock knob in the accommodation cavity.

3. The refrigerator door with the replaceable door surface according to claim 2, wherein the lock knob comprises an outer end portion, and an annular surface of the outer end portion comprises a plurality of first locking members; an outer side wall of the lock case comprises a hole portion, and a hole wall of the hole portion comprises a plurality of second locking members; wherein the outer end portion matches with the hole portion, and when the snap tab is rotated to the first position, each first locking member and each second locking member are locked with each other.

4. The refrigerator door with the replaceable door surface according to claim 3, wherein the press lock catch further comprises a button, and an outer side of the outer side wall is provided with an insertion hole, into which the button is inserted; wherein the insertion hole and the hole portion are communicated with each other, and the button is pressed to pass through the insertion hole and push the outer end portion in the hole portion, such that the lock knob axially moves in the accommodation cavity, and the first locking members and the second locking members are unlocked.

5. The refrigerator door with the replaceable door surface according to claim 4, wherein the button comprises a push rod therein; and the push rod enters the hole portion and pushes the outer end portion, the first positioning portion slides along the second positioning portion, and the compression torsional spring is compressed, such that the first locking members and the second locking members are unlocked.

6. The refrigerator door with the replaceable door surface according to claim 3, wherein the first locking members are recesses formed in the outer end portion; the second locking members are bulges formed on the hole wall; and wherein the bulges are snapped into the recesses, such that the lock knob and the lock case are locked.

7. The refrigerator door with the replaceable door surface according to claim 3, wherein the plurality of first locking members is evenly distributed on the annular surface in a circumferential direction in accordance with a first angle; an angle at which the snap tab rotates between the first position and the second position is defined as a second angle; and wherein the first angle is greater than the second angle.

8. The refrigerator door with the replaceable door surface according to claim 2, wherein the first positioning portion is a strip-shaped groove, and the second positioning portion is a strip-shaped bump.

9. The refrigerator door with the replaceable door surface according to claim 1, wherein the fixed seat, the compression torsional spring, and the lock knob are accommodated in the accommodation cavity, and when the snap tab is at the second position, the compression torsional spring is in a torsion state.

10. The refrigerator door with the replaceable door surface according to claim 1, wherein the snap tab comprises a snap slot, which protrudes from a cylindrical body of the snap tab; the hook is a U-shaped frame, and an opening of the U-shaped frame is connected to the rear side of the door shell plate; and wherein a cross bar of the U-shaped frame is snapped into the snap tab.

11. The refrigerator door with the replaceable door surface according to claim 1, wherein the first positioning portion is a strip-shaped groove, and the second positioning portion is a strip-shaped bump.

12. A refrigerator door with a replaceable door surface, comprising:

a foamed door body and a door shell plate detachably connected to the foamed door body;

wherein a rear side of the door shell plate is provided with a hook; a front side of the foamed door body is provided with a press lock catch, which comprises a snap tab; and when the door shell plate is assembled on the front side of the foamed door body, the hook is snapped into the snap tab to limit the displacement of the door shell plate in a front-rear direction;

wherein the press lock catch comprises a lock case, which comprises an assembly cavity in which the snap tab is rotatably assembled, wherein when the snap tab is rotated in the assembly cavity to a first position in a first direction, the hook is snapped into the snap tab; when the snap tab is rotated in the assembly cavity to a second position in a second direction, the hook is disengaged from the snap tab; and the first direction and the second direction are opposite;

wherein the press lock catch further comprises a fixed seat, a compression torsional spring, and a lock knob, both ends of the compression torsional spring are respectively fixed to the fixed seat and the lock knob, and the fixed seat, the compression torsional spring, and the lock knob are respectively accommodated in an accommodation cavity of the snap tab; and wherein the compression torsional spring is capable of driving the lock knob and the snap tab to rotate together relative to the fixed seat between the first position and the second position;

wherein a first positioning portion is disposed on an inner wall of the accommodation cavity of the snap tab, a second positioning portion is disposed on an outer wall of the lock knob, and the first positioning portion and the second positioning portion are in snap fit with each other to limit the axial rotation of the lock knob in the accommodation cavity.

13. The refrigerator door with the replaceable door surface according to claim 12, wherein the lock knob comprises an outer end portion, and an annular surface of the outer end portion comprises a plurality of first locking members; an outer side wall of the lock case comprises a hole portion, and a hole wall of the hole portion comprises a plurality of second locking members; wherein the outer end portion matches with the hole portion, and when the snap tab is rotated to the first position, each first locking member and each second locking member are locked with each other.

14. The refrigerator door with the replaceable door surface according to claim 13, wherein the press lock catch further comprises a button, and an outer side of the outer side wall is provided with an insertion hole, into which the button is inserted; wherein the insertion hole and the hole portion are communicated with each other, and the button is pressed to pass through the insertion hole and push the outer end portion in the hole portion, such that the lock knob axially moves in the accommodation cavity, and the first locking members and the second locking members are unlocked.

15. The refrigerator door with the replaceable door surface according to claim 14, wherein the button comprises a push rod therein; and the push rod enters the hole portion and pushes the outer end portion, the first positioning portion slides along the second positioning portion, and the compression torsional spring is compressed, such that the first locking members and the second locking members are unlocked.

16. The refrigerator door with the replaceable door surface according to claim 13, wherein the first locking members are recesses formed in the outer end portion; the second locking members are bulges formed on the hole wall; and wherein the bulges are snapped into the recesses, such that the lock knob and the lock case are locked.

17. The refrigerator door with the replaceable door surface according to claim 13, wherein the plurality of first locking members is evenly distributed on the annular surface in a circumferential direction in accordance with a first angle; an angle at which the snap tab rotates between the first position and the second position is defined as a second angle; and wherein the first angle is greater than the second angle.

* * * * *